US005335990A

United States Patent [19]

Maxon, III

[11] Patent Number: 5,335,990

[45] Date of Patent: Aug. 9, 1994

[54] CONCRETE REMIX AND TRANSFER DEVICE

[75] Inventor: Glenway W. Maxon, III, Mequon, Wis.

[73] Assignee: Maxon Industries, Inc., Milwaukee, Wis.

[21] Appl. No.: 127,810

[22] Filed: Sep. 28, 1993

[51] Int. Cl.[5] ..... B28C 7/16; B01F 15/02

[52] U.S. Cl. ..... 366/42; 366/64; 366/186; 366/195; 366/196

[58] Field of Search ..... 366/64, 186, 196, 50, 366/37, 38, 97, 190, 194, 195, 603, 292, 281, 345, 346, 42, 43; 414/502, 526

[56] References Cited

U.S. PATENT DOCUMENTS

| | | | |
|---|---|---|---|
| 2,490,241 | 12/1949 | Smith | 414/526 |
| 3,182,919 | 5/1965 | Geerlings | 366/603 |
| 3,377,000 | 4/1968 | Mason | 366/186 |
| 3,469,824 | 9/1969 | Futty | 366/64 |
| 4,441,820 | 4/1984 | Maxon | 366/26 |
| 4,795,264 | 1/1989 | Riker | 366/38 |

*Primary Examiner*—Robert W. Jenkins

*Attorney, Agent, or Firm*—Andrus, Sceales, Starke & Sawall

[57] ABSTRACT

A mobile concrete remix and transfer device includes an elongate open-topped surge bin, a remixing and transfer agitator rotatably mounted in the bin to move concrete toward one end, and an upwardly inclined discharge screw conveyor mounted in one end of the bin to transfer concrete therefrom to an upper discharge end near the upper edge of the surge bin. The device is particularly useful for direct or shuttle transfer hauling within the close confines of tunnel construction in a manner in which concrete can be loaded into and discharged from the bin at points directly adjacent the open upper edge thereof without the need for vertical lifting or tilting adjustment of the bin. The device may also be skid-mounted and positioned directly on the ground, loaded directly from a low discharge height truck mixer, and discharged directly into a concrete pump hopper, bucket, or the like.

8 Claims, 2 Drawing Sheets

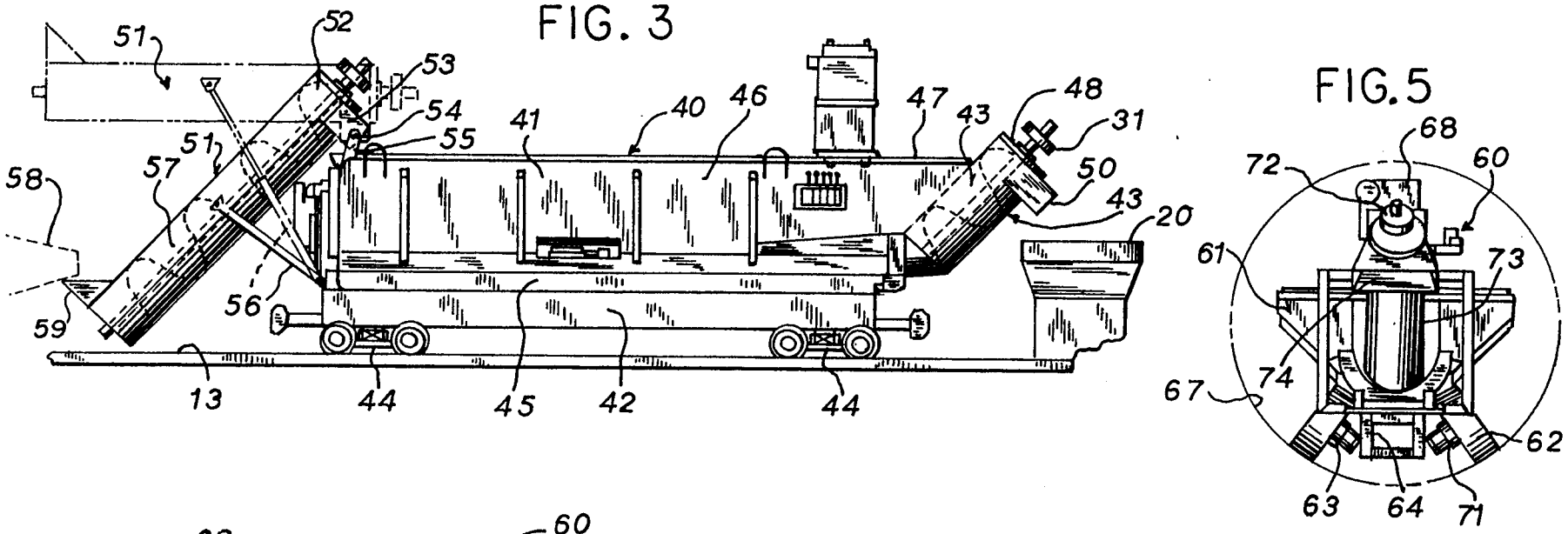
FIG. 5
FIG. 3
60
68
72
73
74
61
67
62
71
64
63
20
31
48
50
43
47
46
40
41
42
45
44
13
53
54
55
52
51
56
57
58
59
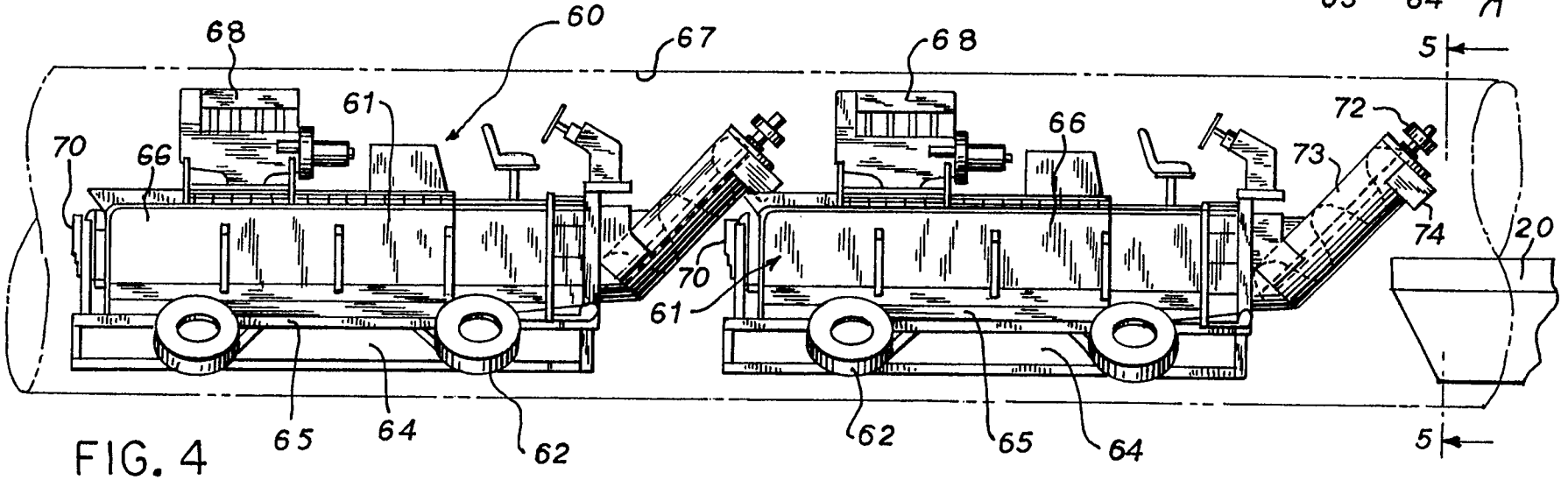
FIG. 4
20
5
5
74
72
73
64
66
65
68
62
70
61
67
60
62
64
61
65
68
66
70

CONCRETE REMIX AND TRANSFER DEVICE

BACKGROUND OF THE INVENTION

The present invention pertains to a remix hopper and transfer device for concrete and similar materials and, more particularly, to a compact mobile device particularly adapted for use in confined areas such as tunnel construction.

The prior art is repleat with devices designed and constructed to facilitate the placement of concrete at construction sites and to simultaneously provide temporary storage or surge capability to allow delivered batches of concrete to be stored for short periods until transferred for placement. Such devices also typically include an agitator to remix or retemper the concrete while it is being held in the storage bin on the device. These devices are also often designed for mobile travel such as by mounting the device on a rail carriage for operation on a track or on a wheeled chassis which may or may not be self-propelled.

In order to accommodate the manner in which ready mixed concrete is delivered to a construction site, the nature of the construction activity, and the manner in which the concrete is ultimately placed in the structure, remix hoppers or surge bins include a variety of devices to accommodate loading and a similar variety of devices to facilitate discharge. A typical application for a mobile surge bin is in tunnel construction. The bins typically comprise a conventional elongate open-topped body mounted on a frame which, in turn, is supported on rubber tires or a rail wheel carriage. However, the bin may also be temporarily used in a stationary position supported on its subframe and without any wheeled support. The bin may include a remixing and transfer agitator typically including a series of paddles rotatable on a longitudinal axis to move the concrete toward the rear end for discharge through a vertically openable gate, the position of which can be varied to meter discharge. The open-topped bin may also be pivotally attached to the carriage near the discharge gate to allow the front end of the bin to be lifted to facilitate discharge. A belt conveyor may also be attached to the rear of the device to receive at its lower end concrete discharged through the gate and to carry the concrete upwardly at an angle to an elevated conveyor discharge end. This allows concrete to be placed at a substantially higher level than may be accommodated by the discharge gate. For example, the higher discharge may be required in order to place concrete into the hopper feeding a concrete pump or to deliver concrete to another mobile surge bin for use in shuttle delivery, as in the construction of a tunnel.

Another known construction for a surge bin eliminates the need for an elevating discharge belt conveyor by utilizing a lift mechanism which raises the entire bin vertically from the chassis or carriage to place the discharge gate at an elevated position. Such lift mechanisms may also provide corresponding tilt to the bin to further facilitate rearward movement and discharge of the concrete. This device is shown in U.S. Pat. No. 4,441,820 granted to the inventor of the subject invention.

Both of the foregoing types of surge bins may be fed or supplied concrete by ready mix carriage vehicles which simply dump directly over the open upper peripheral edge of the bin into the open interior. Alternately, concrete may be supplied to the surge bin by a belt conveyor attached to the front end of the bin and having an upper discharge end positioned above the open interior and a lower feed end extending longitudinally forward of the apparatus. One major disadvantage of surge bins which must be lifted to discharge is that their operation is cyclic, thus preventing loading during discharge and vice versa.

Two primary factors in tunnel construction, particularly in smaller diameter confined tunnels having, for example, diameters of 12 feet or less, make use of any of the foregoing prior art types of mobile surge bins impractical or impossible. First of all, the inherent low head room will not accommodate tilt or lift mechanisms which raise the surge bin body vertically above the supporting carriage or chassis. Second, longitudinal space along the tunnel construction site is typically limited and, therefore, long belt conveyors used both for discharge and for loading the surge bin add significantly to the length of required equipment space and are, therefore, undesirable.

Notwithstanding the inherent limitations imposed by tunnel construction in relatively small diameter passages, mobile remixing surge bins can provide a cost effective and operationally satisfactory system if the problems related to height and length space limitations can be overcome while still allowing the surge bins to be loaded and discharged at approximately the level of their peripheral upper edges. This includes the need to provide shuttle transfer of concrete from one surge bin to the next where lateral space constraints preclude side-by-side passage of vehicles. Any alternate means which may be provided to load and/or unload the surge bin must be at least as efficient and effective as prior art devices. Also, the device should be able to be effectively loaded from a horizontal concrete carrier, such as a Moran car, commonly used in tunnel construction.

SUMMARY OF THE INVENTION

The present invention comprises improvements in a conventional remix hopper and material transfer device for concrete and similar materials of the type which has an elongate open-topped surge bin defined by an upper peripheral edge over which concrete or other material is loaded into the bin, and a remixing and transfer agitator which is mounted in the bin and rotatable about a longitudinal axis to move the concrete toward one end for discharge. The improved apparatus includes an inclined screw conveyor mounted within the surge bin at one end thereof and positioned with its axis of rotation extending upward at an angle from a lower end located near the bottom of the end of the bin to an upper discharge end located near the upper edge of the bin. Concrete or other material may be loaded into and discharged from the surge bin at points directly adjacent the upper edge without vertical lifting or tilting of the bin. The screw conveyor is preferably operated by a variable speed drive to provide metered discharge of the concrete or other material. In one embodiment, the discharge end of the screw conveyor is positioned at a height slightly above the peripheral upper edge of the bin to permit direct discharge over the edge and into the bin of an adjacently positioned device of the same type. In another embodiment, a second inclined screw conveyor may be mounted on the other end of the bin and on the outside thereof, such that the second conveyor is positionable to place its axis of rotation to extend upwardly at an angle for loading concrete over the upper edge and into the bin. The second screw conveyor may be pivotally mounted for movement about a horizontal transverse axis for vertical adjustment of the loading hopper.

The device of the present invention may be supported for use directly on its subframe or mounted on a wheeled chassis to support the surge bin for mobile travel. In one embodiment, the chassis is adapted to travel on rails and, in another, the chassis is adapted to be supported on rubber-tired wheels for travel on the flat or curved bottom surface of an arcuate tunnel.

BRIEF DESCRIPTION OF THE DRAWINGS

FIG. 3 is a side elevation of another embodiment of the invention including a self-loading screw conveyor.

FIG. 4 is a side elevation of another embodiment of the invention supported on a rubber tired chassis.

FIG. 5 is an end elevation of the device shown in FIG. 4.

DETAILED DESCRIPTION OF THE PREFERRED EMBODIMENTS

Figure 1:
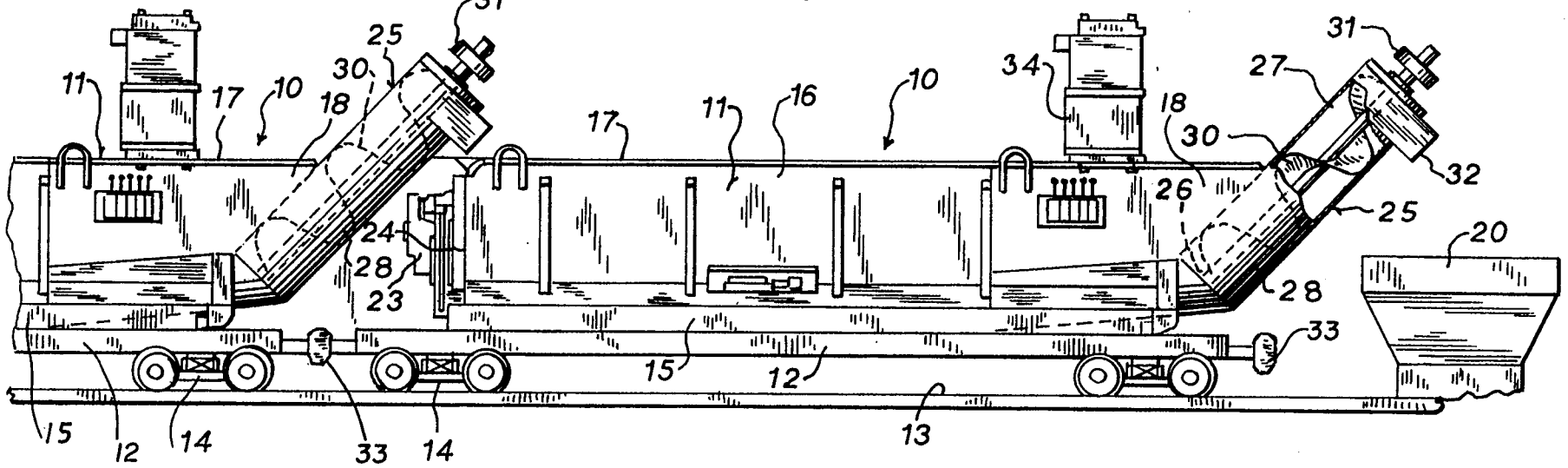
FIG. 1 is a side elevation of one embodiment of the invention in which devices of the present invention are interconnected for shuttle operation on a rail system.
Figure 2:
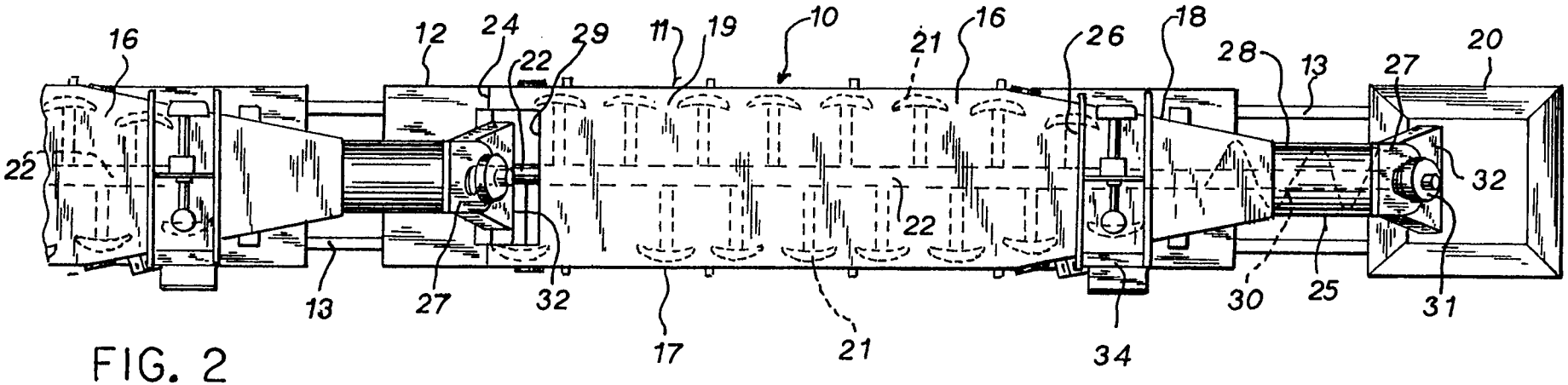
FIG. 2 is a top plan view of the apparatus shown in FIG. 1.

In a principal embodiment of the invention shown in FIGS. 1 and 2, a concrete remix and transfer device 10 includes a surge bin 11 mounted on a chassis frame 12 which is, in turn, supported for travel along a pair of rails 13 by pairs of front and rear rail wheel bogies 14. The surge bin 11 is supported on a subframe 15 and comprises a trough-like hopper 16 with a substantially open top defined by an upper peripheral edge 17. Premixed concrete may be delivered to the remix and transfer device 10 of the present invention and discharged into the surge bin 11 in any convenient manner. For example, if the device is accessible from one or both sides, specialized ready mix concrete hauling vehicles may discharge directly over the upper edge 17 into the hopper 16. Such vehicles include well known haul body trucks with specialized dump bodies and conventional truck mixers. However, if the device of the present invention is operating within a tunnel system under construction, the only practical manner of delivering concrete may be along the rails 13 and into the loading end 24 of the surge bin. For example, if concrete is being supplied to a concrete pump, it may be necessary to transport concrete along significant lengths of completed tunnel to the location where the concrete is being poured or discharged by the pump for placement. In such cases, it may be necessary to locate one device 10 in a position where it can discharge directly into the hopper 20 of a concrete pump (not shown) and to utilize another identical device 10 to shuttle concrete from an upstream location where it is delivered to the site downstream to the remix and transfer device positioned adjacent the concrete pump.

In a conventional manner, each surge bin 11 includes an agitator comprising a series of mixing and transfer paddles 21 mounted on a longitudinally extending shaft 22 which is supported for rotation in the hopper 16 and driven by a gear box hydraulic drive 23 mounted on the hopper 16 at the loading end 24 of the hopper. Rotation of the shaft 22 in one direction operates the paddles 21 to remix the concrete while it is held in the surge bin 11 and move the concrete generally toward the loading end 24, and rotation of the shaft in the opposite direction causes the concrete to be moved to the discharge end 18 of the hopper for discharge. The hopper may be closed with an upper top closure plate 19, an open safety grate (not shown) or left open. The closure plate includes a charge opening 29 at the loading end 24.

In accordance with the present invention, concrete is discharged from the surge bin 11 by a short screw conveyor 25 mounted directly within the discharge end 18 of the hopper 16. The screw conveyor extends upwardly at an angle from a lower end 26, which receives concrete moved to it by operation of paddles 21, to an upper discharge end 27 extending upwardly beyond the upper edge 17 of the hopper at the discharge end of the unit. The screw conveyor 25 includes a conventional closed U-shaped trough 28 connected to the discharge end of the bin and within which is disposed a rotatable spiral discharge blade 30 driven by a motor 31 mounted on the upper end thereof. The spiral blade 30 carries concrete upwardly along the trough 28 to a short discharge chute 32 at the upper end of the trough.

In the specific embodiment shown in FIGS. 1 and 2, the screw conveyor 25 has an extended length which allows the discharge chute 32 to extend over the upper edge 17 at the loading end 24 of an adjacently positioned remix and transfer device 10, so that concrete can be transferred from one device to another in a shuttle 10 system as discussed above. The chassis frames 12 supporting the devices 10 of the present invention may, of course, be provided with conventional wheels and couplings 33 to enable a train of devices to be operated together along the rails 13, if necessary or desirable. The screw conveyor motor 31 is preferably driven by a motor-operated hydraulic power unit 34 mounted atop the hopper 16 in any conventional position. The total height of the device, from the rails to the top of the power unit 34, may be easily limited to 10 feet or less, making the system suitable for use in tunnels of 12 foot diameter or smaller. If necessary, even further down sizing could be attained to reduce the overall height. The height of the discharge end 27 of the screw conveyor is dictated, in this particular application, by the desire to enable transfer of concrete to an adjacent unit. However, if concrete need only be delivered to the hopper 20 of a concrete pump or a similar lower profile receptacle, the length of the screw conveyor could be reduced, as will be described with respect to another embodiment. However, as will be seen in the drawings, even the extended length screw conveyor 25 has a length which is substantially shorter than would be required if a belt conveyor were used to discharge concrete from the device. The screw conveyor can be much more steeply inclined because of the positive transfer action of the spiral blade 30, as opposed to a belt conveyor which cannot be more steeply inclined than movement of the material thereon under the influence of gravity will permit. The ability to use a relatively short length transfer device, of course, also allows adjacent units to be coupled closely together, thereby minimizing the length of the supporting chassis 12 and the overall length of the device. This significant saving in length is most desirable in the typically close confines and limited space available in a tunnel construction site. The variable speed hydraulic power unit 34 can provide variable volume discharge to maximum capacities greater than that which could be provided by a comparable belt conveyor, thereby maximizing transfer and discharge deficiency.

The device shown in FIGS. 1 and 2 may also be built without the wheeled chassis frame 12, and supported for use directly on the subframe 15. Although such use would obviously lower the discharge height of the chute 32, it would still be high enough to reach most concrete pump hoppers and conventional concrete transfer buckets. In this configuration, the remix hopper can be charged directly from a truck mixer which has an inherently low and limited discharge height.

FIG. 3 shows a modified remix and transfer device 40 which is much like the device shown in FIGS. 1 and 2, except that it includes a self-loading feature and a somewhat shorter inclined discharge screw conveyor 43. Thus, the device includes a surge bin 41 including a supporting subframe 45 which, in turn, is mounted on a rail car frame 42 operable over the rails 13 on bogies 44. The discharge screw conveyor 43 has a substantially shorter length than the screw conveyor 25 of the FIG. 1 embodiment. As shown in FIG. 3, the screw conveyor 43 has an upper discharge end 48 which terminates near the upper peripheral edge 47 of the hopper 46, such that the discharge chute 50 is located at a lower level than the corresponding chute 32 of the previously described embodiment. However, the discharge chute 50 still provides an adequate discharge height to supply concrete from the surge bin 41 to the hopper 20 of a concrete pump or similar receptacle positioned under the chute. The use of the shorter screw conveyor 43 adds less than 3 feet to the overall length of a similar surge bin having a prior art gate discharge. However, the screw conveyor discharge eliminates the need to use a separate discharge device, such as a belt conveyor, that would be needed to serve a gate discharge unit.

A second screw conveyor 51 for loading concrete into the surge bin 41 is attached to the loading end of the hopper 46. The upper discharge end 52 of screw conveyor 51 is positioned above the upper peripheral edge 47 of the hopper near the loading end thereof and includes a discharge chute 53 for directing concrete into the hopper. The discharge end of the conveyor is supported for pivotal movement about a horizontal transverse pivot 54 extending between a pair of mounting brackets 55. A pair of fluid cylinders 56, each attached at one end to the subframe 45 and the opposite end to the conveyor trough 57, move the conveyor 51 from the solid line loading position wherein it is upwardly inclined with the loading hopper 59 positioned near ground level, to the phantom line storage position where it is horizontally disposed at a level above the upper peripheral edge 47 of the surge bin hopper. With the screw conveyor 51 in the loading position, concrete from a horizontal discharge carrier, such as a Moran car, is loaded directly into the loading hopper 59. As with the discharge screw conveyor 43, the loading screw conveyor 51 can be substantially shorter in length than would be necessary for a belt conveyor used to load the surge bin 41. When the loading screw conveyor 51 is pivoted upwardly to its storage or holding position, the rail carriage frame 42 can be coupled to another car or to a locomotive for transport. In its upper position, the screw conveyor does not increase the overall height of the device or inhibit its use in the tight confines of a tunnel.

In FIGS. 4 and 5, there is shown a mobile self-propelled remix and transfer device 60 which provides a function similar to the previously described embodiments. In this device, the surge bin 61 is supported for movement on rubber-tired wheels 62 which may be individually driven with hydrostatic drive units 63. The surge bin 61, as in the previously described embodiments, includes a hopper 66 mounted on a subframe 65. The subframe and the drive units 63 for the wheels 62 are suitably supported on a frame 64 as shown. The wheels and drive units in this embodiment are positioned at an angle to the vertical so that the mobile unit may readily travel along the semicylindrical floor of a circular tunnel wall 67, as best shown in FIG. 5. Power for the unit may be supplied by a single internal combustion engine 68 which supplies power for various hydraulic drive motors, including paddle drive motor 70, wheel drive motors 71, and hydraulic motor 72 for driving a discharge screw conveyor 73.

Screw conveyor 73 may be identical to the discharge screw conveyor 25, described with respect to the embodiment of FIGS. 1 and 2. Thus, conveyor 73 extends upwardly from within the holding hopper 66 to move concrete to an upper discharge chute 74 disposed at a height sufficient to allow shuttle discharge from one unit 60 directly into the surge bin 61 of an adjacent unit. Also, of course, the discharge chute 74 may be positioned above a conventional concrete pump hopper 20 as with each of the previously described embodiments.

Each of the screw conveyors 25, 43, 51 and 73 of the various embodiments may utilize a 24 inch (61 cm) diameter discharge screw and be driven by similar hydraulic motors 72 providing a variable discharge up to 5 cubic yards per minute (3.8 cubic meters per minute). When operating with remix capability, the surge bin 61 of the FIG. 4 device may be sized to handle approximately 8 cubic yards (6 cubic meters) of concrete. A unit with this capacity can readily be sized to operate in a tunnel having a bore as small as 11.5 feet (3.5 m). Surge bins with capacities up to 10 cubic yards (7.6 cubic meters) or greater may be accommodated in the different devices disclosed herein.

Various modes of carrying out the present invention are contemplated as being within the scope of the following claims particularly pointing out and distinctly claiming the subject matter which is regarded as the invention.

I claim:

1. In a material remix and transfer device for concrete and the like of the type having an elongate open-topped surge bin having an upper peripheral edge over which material is loaded into the bin, and a remixing and transfer agitator mounted in the bin and rotatable about a longitudinal axis extending between opposite bin ends to move material toward either of said bin ends, the improvement comprising:

a screw conveyor mounted within the bin in one end thereof and positioned with its axis of rotation extending upwardly at an angle from a lower end near the bottom of said one end of the bin to an upper discharge end near the upper edge of the bin, whereby material may be loaded into and discharged from the bin directly adjacent to the upper edge thereof without vertical adjustment of the bin.

2. The apparatus as set forth in claim 1 including a variable speed drive for the screw conveyor to provide metered material discharge.

3. The apparatus as set forth in claim 1 wherein the discharge end of the screw conveyor is positioned at a height to permit direct discharge over the upper edge and into the bin of an adjacently positioned device.

4. The apparatus as set forth in claim 1 including a second screw conveyor mounted outside the bin on the other end thereof, said second conveyor positionable to place its axis of rotation to extend upwardly at an angle for loading material over the upper edge and into the bin.

5. The apparatus as set forth in claim 4 wherein said second screw conveyor is pivotally mounted for movement about a horizontal transversely disposed axis.

6. The apparatus as set forth in claim 1 including a wheeled chassis supporting the device for mobile travel.

7. The apparatus as set forth in claim 6 wherein the chassis is adapted to travel on rails.

8. The apparatus as set forth in claim 6 wherein the chassis is adapted to travel along the bottom of an arcuate cross section tunnel.

* * * * *